United States Patent [19]

Koechlin et al.

[11] Patent Number: 4,732,088

[45] Date of Patent: Mar. 22, 1988

[54] SET OF MODULAR ELEMENTS FOR FORMING OFFICE FURNITURES

[76] Inventors: René Koechlin; Marc Mozer, both of 114, route de Florissant, 1206 Geneve, Switzerland

[21] Appl. No.: 927,224

[22] Filed: Oct. 24, 1986

[30] Foreign Application Priority Data

Nov. 20, 1985 [CH] Switzerland ..... 04945/85

[51] Int. Cl.[4] ..... A47B 57/00

[52] U.S. Cl. ..... 108/64; 108/114

[58] Field of Search ..... 108/64, 65, 69, 114, 108/153

[56] References Cited

U.S. PATENT DOCUMENTS

| | | | |
|---|---|---|---|
| 3,339,503 | 9/1967 | Flodell | 108/64 |
| 3,342,147 | 9/1967 | Shettles | 108/64 |
| 3,741,852 | 6/1973 | Keener | 108/64 |

FOREIGN PATENT DOCUMENTS

| | | | |
|---|---|---|---|
| 2444287 | 3/1976 | Fed. Rep. of Germany | 108/65 |
| 2230156 | 1/1975 | France | 108/64 |
| 0618804 | 2/1949 | United Kingdom | 108/64 |

*Primary Examiner*—Kenneth J. Dorner
*Assistant Examiner*—Gerald A. Anderson
*Attorney, Agent, or Firm*—Young & Thompson

[57] ABSTRACT

It comprises at least a first element comprising an hexagonal plate (1), two opposed angles (a) of which have 90°, the other angles (b) being of 135° and all the sides presenting the same length. At least a second element comprises a square plate (6) the length of the sides of which is equal to the length of the sides of the hexagonal plates (1) of the first element.

5 Claims, 14 Drawing Figures

FIG. 13
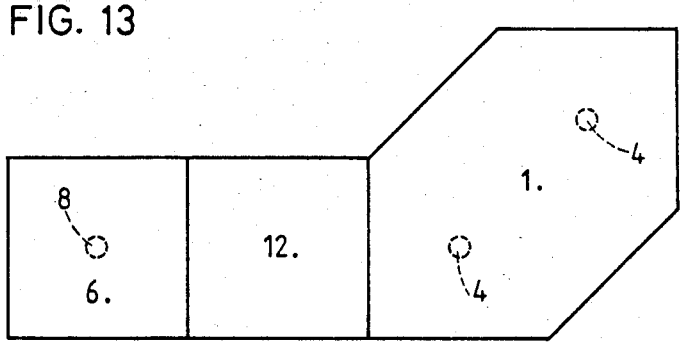
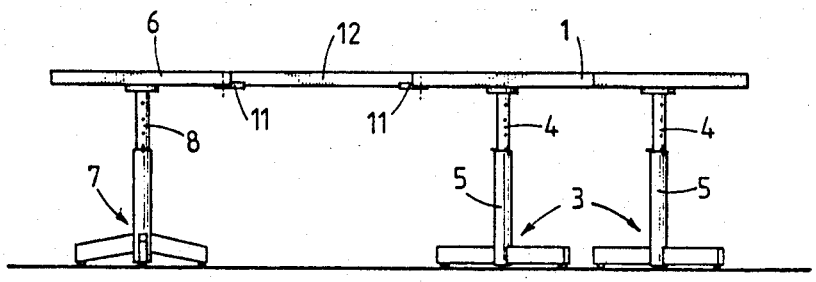
FIG. 14

SET OF MODULAR ELEMENTS FOR FORMING OFFICE FURNITURES

The present invention relates to office furnitures and proposes to create a set of modular elements enabling the realization of a great number of combinations which permits a more efficient and nicer work. This office furniture intends to be functional ergonomic and esthetic.

This aim is achieved by the set of modular elements for the constitution of office furnitures according to the invention which distinguishes itself by the fact that it comprises at least a first element comprising an hexagonal plate two opposite angles of which are of 90°, the other angles being of 135° and all the sides of which have the same length; and at least a second element comprising a square plate the length of the side of which is equal to the length of the sides of the hexagonal plates of the first element.

The attached drawing shows schematically and by way of example one embodiment of some elements of the set according to the invention as well as various combinations of them to form office furnitures.

FIGS. 13 and 14 show from above and from the side a combination using a variant of the base elements.

Figure 1:
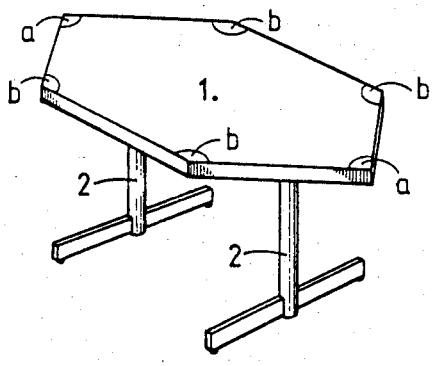
FIG. 1 shows in perspective view a first element having an hexagonal plate.
Figure 2:
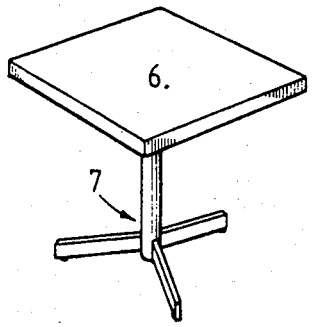
FIG. 2 shows in perspective view a second element having a square plate.
Figure 3:
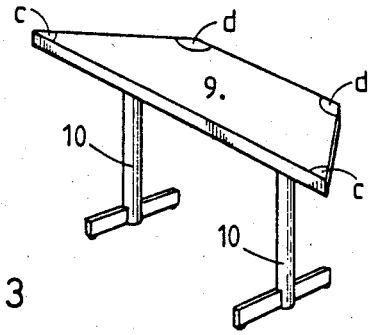
FIG. 3 shows in perspective view a third element having a quadrilateral plate.
Figure 4:
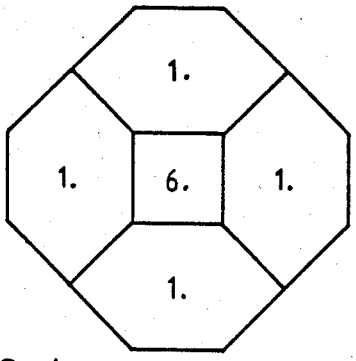
FIGS. 4 to 12 show various office furnitures, working tables, conference tables or personal office tables for one or several persons, obtained by the combination of elements such as those shown at FIGS. 1 to 3.
Figure 5:
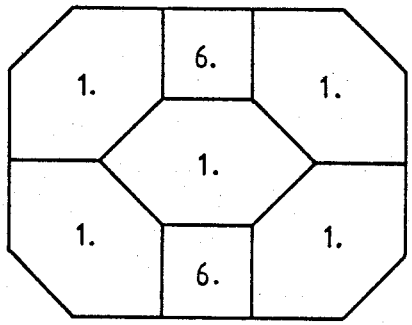

The set of elements proposed comprises three base elements shown at FIGS. 1 to 3.

A first element comprises a plate 1 of hexagonal shape two opposed angles of which a are equal to 90° whereas the others angles b are equal to 135°. All the sides of this hexagonal plate 1 have an identical length.

This plate is fixed onto feet 2 in the example shown, the hight of which may be adjustable through a telescopic system as indicated at FIG. 14, comprising a foot 3 resting on the ground and a tube 4 fixed to the plate 1 and sliding into the central tube 5 of the double feet element and which can be fixed to that feet element in different positions to adjust the hight of the plates 1.

In a variant one can provide for a unique foot element by means of a tripod for example.

A second element comprises a square plate 6 the sides of which have a length equal to the one of the sides of the hexagonal plate 1 of the first element. This second element comprises a foot part presenting a tripod 7 resting on the ground. As shown at FIG. 14, this foot part can also be adjustable in which case it comprises a tube 8 fixed to the plate 6 sliding in the central tube of the foot part 2 and can be fixed therein at different hights.

A third element shown at FIG. 3 comprises a quadrilateral plate 9 comprising two opposed angles c equal to 45°, the two other angles d being equal to 135°. Three of the sides of this plate 9 are equal and have a length equal to the length of the sides of the hexagonal plates 1 of the first element and of the square plate 6 of the second element. This third element has thus a plate 9 which presents exactly the half of an hexagonal plate 1.

In practice, the equal sides of the plates 1, 6 and 9 have 66 cm. in length.

This third element has a foot part similar to the one of the first element, constituted by two double feet 10 which can also be adjustable in hight.

Figure 6:
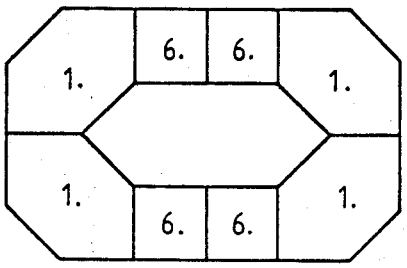
Figure 7:
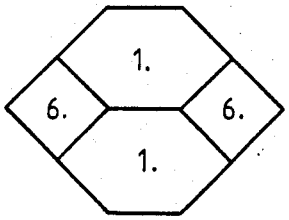
Figure 8:
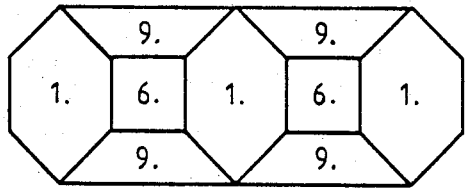
Figure 9:
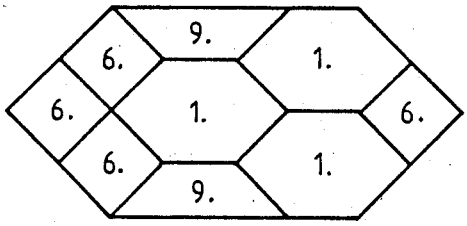
Figure 10:
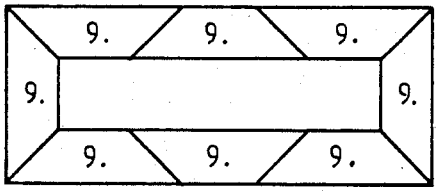
Figure 11:
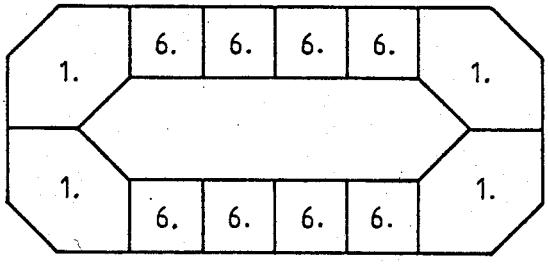

Through the simple juxtaposition of a certain number of elements of the three types described above, it is possible to realize numerous conference tables of different shapes and dimensions. FIGS. 4, 5, 7, 8 and 9 show plain tables of different sizes and FIGS. 6, 10 and 11 tables having a central void.

Figure 12:
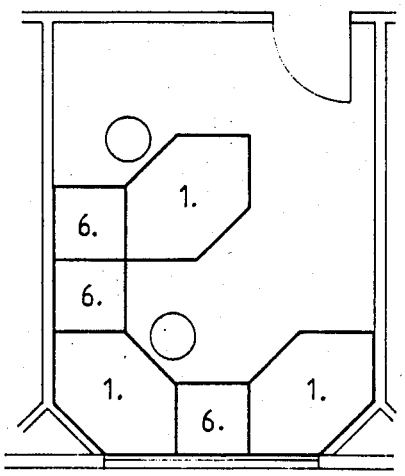

FIG. 12 shows a possible combination of the first and second elements for the creation of an individual place responding to the actual needs, that is to say the use which is more and more intensive of one or even two computer terminals having a keyboard as well as a screen for each office what implies a particular position of these equipments within the room.

The proposed office supply, partially located at 45° in a room, optimalizes the seizing of documents through the operator, the disposition responds to the criteriums given in the brochure "le travail à l'écran de visualisation" published by the National Swiss Insurance Company in case of accidents, that is:

the windows are not located in the visual field of the operator, the windows do not reflect themself in the surface of the screen, the width of the working plate is 90 cm at minimum, the length of the working plate enables a good position of the keyboard and of the document carrier, the hight of the office furniture is adjustable between 68 and 82 cm.

FIGS. 13 and 14 show from above and from the side one configuration in which one intermediate element 12, here the square element, do not comprise feet but is fixed to the adjacent elements by means of slides 11, angle-irons or any other fixing means.

It is evident that intermediary elements having an hexagonal or quadrilateral shape can be provided, also without feet portions and intended to be fixed between two adjacent elements which would have fixing means to this effect.

It is evident that by combining the elements described hereabove, it is possible to create also garden offices.

It is interesting to see that with the aide of only three base elements and three intermediary elements having the same shape as the base elements but without feet portion, it is possible to create all the furniture necessary for an office of a great enterprise; individual rooms, directorial offices, conference rooms and so on and obtain on top of that a particularly functional, ergonomic and esthetical furniture at the same time.

We claim:

1. A set of modular elements for the construction of office furniture, comprising at least one first element comprising a hexagonal plate two opposite angles of which are 90° and four angles of which are 135°, all the sides of the first element being of equal length, at least a second element comprising a square plate the length of the sides of which is equal to the length of one of the sides of the hexagonal plate, and at least a third element having the same size and shape as half the hexagonal plate on one side of an imaginary line interconnecting said two opposite angles, said elements being separate from each other and being assemblable with at least one said third element having its edges juxtaposed to those of three other said elements of which at least one is a said first element and at least one is a said second element and with each of said three elements having an edge juxtaposed to an edge of one other of said three elements.

2. A set as claimed in claim 1, in which at least some of said elements have feet.

3. A set as claimed in claim 1, in which said first element has two feet.

4. A set according to claim 1, in which said square plate has no feet.

5. A set as claimed in claim 4, in which some of said elements have fixing means adapted to support said square plate with no feet.

* * * * *